US006691520B2

(12) United States Patent
Kamoshita et al.

(10) Patent No.: US 6,691,520 B2
(45) Date of Patent: Feb. 17, 2004

(54) PULSE TUBE CRYOCOOLER

(75) Inventors: Tomoyoshi Kamoshita, Tokyo (JP); Yukio Yasukawa, Chiba (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 10/285,677

(22) Filed: Nov. 1, 2002

(65) Prior Publication Data

US 2004/0011060 A1 Jan. 22, 2004

(30) Foreign Application Priority Data

Nov. 5, 2001 (JP) ..... 2001-339174
Mar. 25, 2002 (JP) ..... 2002-082347

(51) Int. Cl.[7] ..... F25B 9/00
(52) U.S. Cl. ..... 62/6
(58) Field of Search ..... 62/6; 60/520

(56) References Cited

U.S. PATENT DOCUMENTS 5,966,942 A * 10/1999 Mitchell ..... 62/6
6,021,643 A * 2/2000 Swift et al. ..... 62/6
6,351,954 B1 * 3/2002 Nogawa et al. ..... 62/6
6,378,312 B1 * 4/2002 Wang ..... 62/6
6,389,819 B1 * 5/2002 Zhu et al. ..... 62/6

* cited by examiner

*Primary Examiner*—William C. Doerrler
(74) *Attorney, Agent, or Firm*—Staas & Halsey LLP

(57) ABSTRACT

A pulse tube cryocooler where conditions under which a difference in refrigeration output due to an installation posture can be reduced as compared with conventional pulse tube cryocoolers and where the refrigeration efficiency of the cryocooler is improved, and the refrigeration output can be raised. The pulse tube cryocooler may have a regenerator coupled to a compressor through a heat radiation part and an internal regenerating agent, with the compressor repeatedly feeding and suctioning a working gas, a pulse tube coupled to the regenerator through a cooling part, and a buffer tank coupled to the pulse tube through a heat radiation part and an inertance tube. A ratio of a space volume of the pulse tube to a space volume of the regenerator may be between 0.75 to 1.5. When a diameter of a circle having an area equal to an inner cross section of the regenerator is made an inner diameter, a value obtained by dividing a length of the regenerator by a square of the inner diameter may be between 0.11 to 0.26. A ratio of an inner cross section of the pulse tube to an inner cross section of the regenerator may be between 0.1 and 0.35.

11 Claims, 5 Drawing Sheets

PULSE TUBE CRYOCOOLER

CROSS-REFERENCE TO RELATED APPLICATIONS

This application claims the benefit of Japanese Patent Application No. JP 2001-339174 filed on Nov. 5, 2001, and Japanese Patent Application No. JP 2002-082347 filed on Mar. 25, 2002, both in the Japanese Patent Office, and the disclosures of the above applications and Japanese Patent Application No. 2002-233114, filed on Aug. 9, 2002, in the Japanese Patent Office, are incorporated herein by reference.

BACKGROUND OF THE INVENTION

1. Field of the Invention

The present invention relates to a cryocooler for forming a cryogenic temperature state. More particularly, the present invention relates to a pulse tube cryocooler using a Stirling cycle and including a pulse tube and a regenerator.

2. Description of the Related Art

Since a cryocooler using a Stirling cycle can obtain cryogenic temperatures by repeatedly compressing and expanding a working gas, it has become widely used in cooling operations, such as for cooling of superconducting elements, refining and separation of gases, infrared ray sensors, or the like.

The operation principle of a Stirling cryocooler, using this Stirling cycle, can be more fully explained using FIGS. 2 and 3. FIG. 2 is an explanatory view showing the outline of a refrigeration cycle, and FIG. 3 is a diagram showing a cycle of rising and falling of a compression piston and a displacer in accordance with a refrigeration cycle.

As illustrated in FIG. 2, a Stirling cryocooler 20 can include a compressor 21 having a compression piston 22, a regenerator 23 having a regenerating agent, a displacer 24 forming an expansion chamber 25 and a compression chamber 28, a cooling part 26 formed between the expansion chamber 25 and the regenerator 23, and a heat radiation part 27 formed around the compression chamber 28. A working gas is sealed under high pressure in a hermetically sealed flow passage constituted by these members, and the compression piston 22, of the compressor 21, and the displacer 24 are reciprocated with a phase difference therebetween.

In FIG. 3, a solid line 22*a* represents a rising and falling of the compression piston 22, and a solid line 24*a* indicates rising and falling of the displacer 24. Solid line 29 represents the total volume change in the cryocooler by the rising and falling of the compression piston 22.

As is seen in the volume (P)—pressure (V) diagram illustrated in FIG. 2, the Stirling cycle encompasses a process having two isothermal changes and two constant-volume changes.

A process from "a" to "b," illustrated in portion (A) of FIG. 2, is an isothermal expansion process, where the compression piston 22 goes down from a top dead point to a bottom dead point so that the working gas in the expansion chamber 25 is expanded, heat Qc is absorbed from the cooling part 26, and cooling is performed.

A process from "b" to "c," illustrated in portion (B) of FIG. 2, is a constant-volume heating process, where the displacer 24 goes up from the bottom dead point to the top dead point, so that the fluid in the expansion chamber 25 is pushed out and into a space at the side of the compression chamber 28 through the regenerator 23 and that pressure is raised.

A process from "c" to "d," illustrated in portion (C) of FIG. 2, is an isothermal compression process, where the compression piston 22 goes up from the bottom dead point to the top dead point, so that the working gas is fed into the compression chamber 28, and is isothermally compressed by radiating heat Qh at the heat radiation part 27.

Finally, a process from "d" to "a," illustrated in portion (D) of FIG. 2, is a constant-volume cooling process, where the displacer 24 goes down from the top dead point to the bottom dead point, such that the fluid in the compression chamber 28 is pushed out to the side of the expansion chamber 25 through the regenerator 23, the pressure falls, and the cycle is ended.

In this cycle, as shown by the solid lines 22*a* and 24*a* of FIG. 3, the phase difference between the compression piston 22 and the displacer 24 is set to approximately 90 degrees.

As stated above, in the Stirling cryocooler, the compression piston is displaced by mechanical power, so that the pressure of the working gas in the sealed space is changed. The working gas in the expansion chamber is expanded, to cool, using the displacer moving in synchronization with the periodic change of this pressure. Therefore, a high heat efficiency can usually be achieved.

On the other hand, as a cryocooler using this Stirling cycle, a pulse tube cryocooler shown in FIG. 4 is also known.

Pulse tube cryocooler 10 is provided with a compressor 11 to repetitively feed and suction a working gas, a regenerator 13, coupled to the compressor 11 through a heat radiation part 12 and having a regenerating agent, a pulse tube 15, coupled to the regenerator 13 through a cooling part 14, and a buffer tank 18 coupled to this pulse tube 15 through a heat radiation part 16 and an inertance tube 17.

A working gas such as helium, nitrogen or hydrogen can be sealed under high pressure in a hermetically sealed space of this pulse tube cryocooler 10. Then, similarly to the foregoing Stirling cryocooler, expansion and compression of the working gas is repeated by the compressor 11 to form a pressure amplitude.

Here, in the pulse tube cryocooler 10, the working gas 30 in the pulse tube 15 oscillates minutely in the flow passage, such that it functions as the displacer in the foregoing Stirling cryocooler example. Accordingly, the working gas 30 can be made to work by controlling the phase of the displacement of the oscillating working gas 30 and the pressure displacement. Heat Q1 and Q3 are radiated from the heat radiation parts 12 and 16, heat Q2 is absorbed in the cooling part 14 which becomes a cold head of the cryocooler, such that a cryogenic temperature state is formed. The inertance tube 17 and the buffer 18 serve to control the phases of the displacement of the oscillating working gas 30 and the displacement of the compression piston.

In this pulse tube cryocooler, the displacer installed in the Stirling cryocooler is not necessary, and instead of the displacer, the high pressure gas is minutely oscillated so that the working gas can be compressed and expanded. Therefore, there are no movable parts in the low temperature portion. Thus, since mechanical oscillation does not exist at a cooling head, an equipment structure becomes simple, resulting in high efficiency and reliability.

The output (cryocooler output) in the above pulse tube cryocooler is determined by a difference between an output (hereinafter referred to as an indicated cryocooler output) in proportion to the product of a pressure amplitude and a flow amplitude in the inner area of the pulse tube, and various heat losses generated inside the cryocooler. This is represented by the following relation.

(refrigeration output)=(indicated refrigeration output)−(heat loss)

In order to improve the cooling efficiency of the pulse tube cryocooler, an understanding of the following two desired results become important: (1) to increase the indicated refrigeration output by efficiently transmitting the pressure amplitude given by the compression piston of the compressor into the pulse tube, and (2) to reduce the heat loss due to heat conduction in respective structural units, especially in the regenerator.

First, with respect to the regenerator, in order to reduce the above heat loss, it becomes necessary to reduce heat conduction through the structure of the regenerator, due to the temperature difference between the heat radiation part 12 and the cooling part 14, illustrated in FIG. 4. That is, potential heat of the working gas supplied and exhausted from the compressor 11 is temporarily stored, and the inflow of heat from the heat radiation part 12 of the high temperature side to the cooling part 14 of the low temperature side through the working gas is reduced.

For this purpose, it is conceivable that the heat capacity can be increased by increasing the inner volume of the regenerator 13, or heat resistance can be increased by elongating the regenerator 13 in an axial direction.

However, on the other hand, from the viewpoint of the indicated refrigeration output, in order to efficiently transmit the pressure amplitude generated in the compressor 11 to the pulse tube 15, it is necessary that the pressure loss of the regenerator 13 be small. Accordingly, from this viewpoint, it is also preferable that the length of the regenerator 13 be short.

Accordingly, it is conceivable that with respect to the regenerator 13, the inner volume, length, etc., of the regenerator be optimized so as to satisfy the above contradictory requests.

On the other hand, also with respect to the pulse tube 15, in order to reduce the above heat loss, the heat conduction through the structural member of the pulse tube is lowered, caused by the temperature difference between the heat radiation part 16 and the cooling part 14. The heat resistance in the axial direction in the pulse tube 15 should be large, and therefore, the pulse tube 15 can be made long in the axial direction to increase heat resistance.

However, similarly to the regenerator 13, in view of securement of the pressure amplitude to increase the indicated refrigeration output, with respect to the pressure amplitude from the compressor 11, it is necessary to keep the pressure amplitude in the pulse tube 15 at a large value. Thus, from the viewpoint of the pressure loss, the length of the pulse tube 15 should be short. Accordingly, also with respect to the pulse tube 15, the inner volume, length, etc. of the pulse tube should be optimized so as to satisfy the contradictory requests at the same time.

Since the above regenerator 13 and the pulse tube 15 are united to make up the cryocooler, it is conceivable that there is an optimum range also with respect to the relation of volume, length, etc., of the regenerator 13 to those of the pulse tube 15, and it is conceivable that the efficiency of the cryocooler is greatly influenced by this optimum range.

Accordingly, one problem of conventional systems is their lack to provide a pulse tube cryocooler having high refrigeration efficiency by optimizing the above respective contradictory conditions.

A pulse tube cryocooler is superior in that there is no mechanical oscillation, allowing for a simplification of equipment structure and improvement of reliability. However, as noted above, the conventional pulse tube cryocooler is flawed since the refrigeration output is apt to be changed by an installation posture, that is, a relative positional relation between the regenerator and the pulse tube at the time of installation. It is therefore necessary to form a structure which is not affected much by this installation posture.

As set forth above, a refrigeration output of the pulse tube cryocooler can be represented by the following expression.

(refrigeration output)=(indicated refrigeration output)−(heat loss)

In the "heat loss" of this expression, noting that heat loss is affected by the installation posture of the cryocooler, there is such a heat loss that a sealed working gas generates convection in the pulse tube inner area and the regenerator inner area, with heat entering into the cold head from the high temperature end.

Since the cold head is at a cryogenic temperature of, for example, approximately 70 K, and the high temperature end is normally at a normal temperature (approximately 300 K), the density of the working gas varies greatly between the cold head and the high temperature end. Therefore, convection by gravity occurs, and the degree of this convection can be affected by the installation posture. Thus, the heat loss by this convection is also affected by the installation posture.

Hereinafter, the influence of the installation posture will be described with a pulse tube, as an example.

In an installed state, the cold head of the pulse tube is positioned to be higher than the high temperature end, whereby the temperature of the working gas in the inner space of the pulse tube has such a state that the temperature of the lower part in contact with the high temperature end is high as compared with the upper part in contact with the cold head. Therefore, the density of the working gas in the inner space of the pulse tube becomes large in the upper part and small in the lower part, and the working gas generates convection by the influence of gravity. As a result, the working gas in the lower part in contact with the high temperature end rises and transmits heat to the cold head disposed at the upper part, and the working gas in the upper part in contact with the cold head transmits cold heat to the high temperature end disposed in the lower part, so that heat loss occurs, and the refrigeration output of the cryocooler is lowered.

On the other hand, in an installed state, where the cold head of the pulse tube is positioned to be lower than the high temperature end, the temperature of the working gas in the inner space of the pulse tube becomes such that the temperature of the upper part in contact with the high temperature end is high as compared with the lower part in contact with the cold head. Therefore, density of the working gas in the inner space of the pulse tube becomes large in the lower part and small in the upper part. Accordingly, in this installation posture, since the working gas does not generate convection, due to gravity, and the heat loss by the convection can be neglected, a high refrigeration output can be obtained.

Embodiments of the present invention are directed to solve the aforementioned difficulties of the conventional pulse tube cryocooler, as described above. In addition, embodiments of the present invention provide a pulse tube cryocooler in which a difference in a refrigeration output due to a difference in an installation posture is reduced, such that a stable refrigeration output can be obtained even under various installation conditions.

SUMMARY OF THE INVENTION

To solve the above-described problems, it is an aspect of the present invention to provide a pulse tube cryocooler having a high refrigeration output compared to conventional cryocoolers by setting space volumes, lengths, cross sections, etc., of a regenerator and a pulse tube at specific ratios.

Additional aspects and advantages of the invention will be set forth in part in the description which follows and, in part, will be obvious from the description, or may be learned by practice of the invention.

Accordingly, to achieve the above and other aspects, an embodiment of the present invention includes a pulse tube cryocooler having a compressor to repeatedly feed and suction a working gas, a regenerator coupled to this compressor through a heat radiation part and having a regenerating agent, a pulse tube coupled to the regenerator through a cooling part, and a buffer tank coupled to the pulse tube through a heat radiation part and an inertance tube. This pulse tube cryocooler can be characterized in that a ratio of a space volume of the pulse tube to a space volume of the regenerator becomes 0.75 to 1.5.

By setting the ratio of the space volume of the pulse tube to that of the regenerator in this range, from the viewpoint of the indicated refrigeration output, the pressure amplitude generated in the compressor can be efficiently transmitted to the pulse tube, occurrence of the heat loss can be suppressed, and the refrigeration efficiency can be improved.

The ratio of a length of the pulse tube to a length of the regenerator may be 0.9 to 1.9. Such that, since the loss of the pressure amplitude generated in the compressor can be further lowered, the refrigeration efficiency of the cryocooler is improved, and the refrigeration output can be raised.

To achieve the above and other aspects, an embodiment of the present invention includes a pulse tube cryocooler having a compressor to repeatedly feed and suction a working gas, a regenerator coupled to this compressor through a heat radiation part and having a regenerating agent, a pulse tube coupled to the regenerator through a cooling part, and a buffer tank coupled to the pulse tube through a heat radiation part and an inertance tube, and characterized in that when a diameter of a circle having an area equal to an inner cross section of the regenerator is made an inner diameter, a value obtained by dividing a length of the regenerator by a square of the inner diameter becomes 0.11 to 0.26.

By setting the length of the regenerator and the cross section in this range, the heat resistance in an axial direction in the regenerator can be made large to suppress a heat loss, while suppressing a pressure loss so that a pressure amplitude generated in the compressor can be efficiently transmitted to the pulse tube, thereby making it possible to raise the indicated refrigeration output and to improve the refrigeration efficiency.

To achieve the above and other aspects, an embodiment of the present invention includes a pulse tube cryocooler where conditions under which a difference in refrigeration output due to an installation posture can be reduced as compared with conventional pulse tube cryocoolers.

In an additional embodiment, in a pulse tube cryocooler having a pulse tube and a regenerator linearly disposed, a ratio of an inner cross section of the pulse tube to an inner cross section of the regenerator may be set to not less than 0.1 and not higher than 0.35.

Alternatively, in another pulse tube cryocooler embodiment, the inner diameter of the pulse tube may be set to 12 mm or less.

Thus, when a pulse tube cryocooler, according to embodiments of the present invention, is constructed such that a ratio of an inner cross section of the pulse tube to an inner cross section of the regenerator, or if the inner diameter of the pulse tube is set to be within particular ranges, the heat loss due to natural convection of the working gas generated in the inner space of the pulse tube can become equivalent to the heat loss due to natural convection of the working gas generated in the inner space of the regenerator, even if the installation posture is changed up and down. Since the heat losses of both are cancelled, the difference in the refrigeration output caused by the installation posture can be reduced, and the pulse tube cryocooler with a stable refrigeration output can be obtained under various installation conditions.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
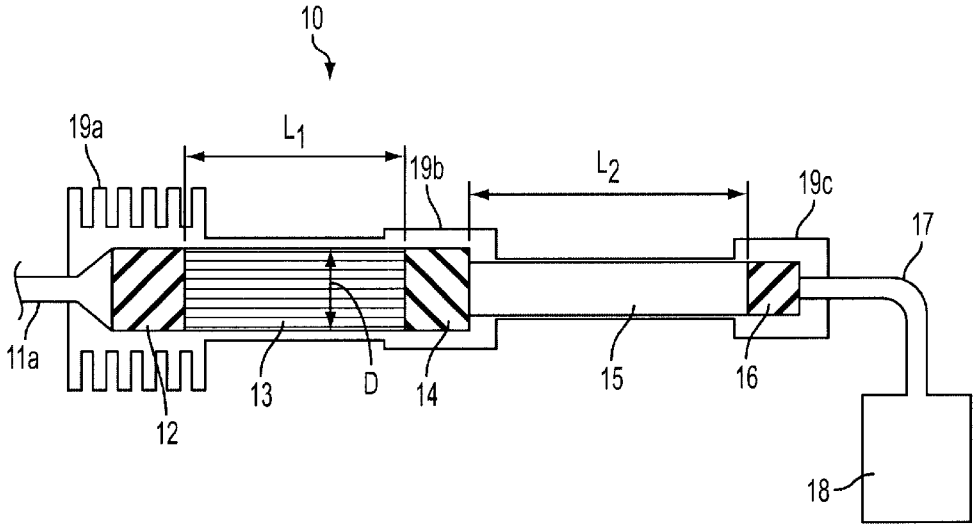
FIG. 1 is an illustration of a schematic structural view showing a pulse tube cryocooler according to an embodiment of the present invention.
Figure 2:
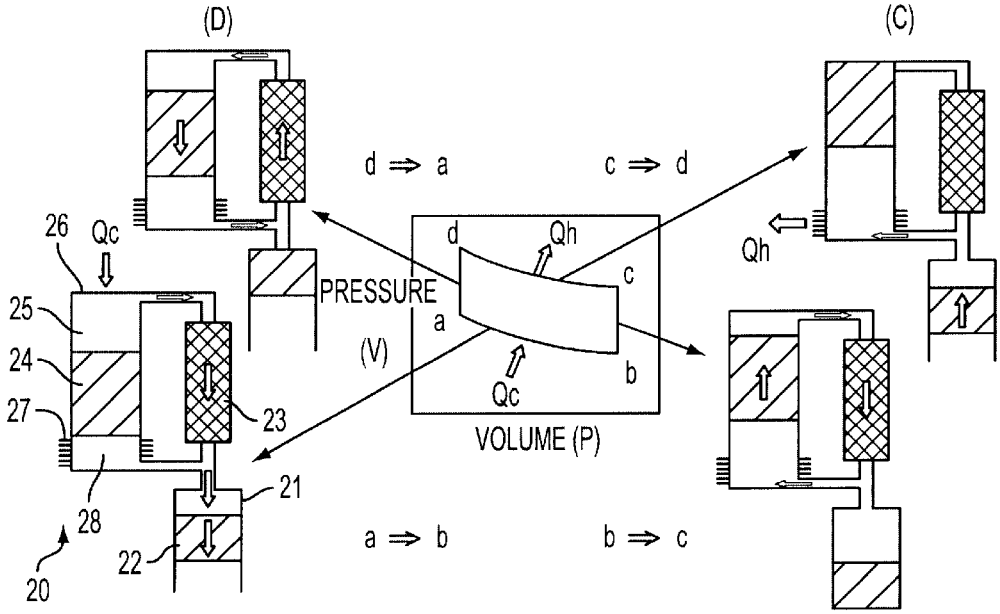
FIG. 2 (PRIOR ART)
FIG. 2 is a schematic explanatory illustration showing operation principles of a Stirling cryocooler using a Stirling cycle.
Figure 3:
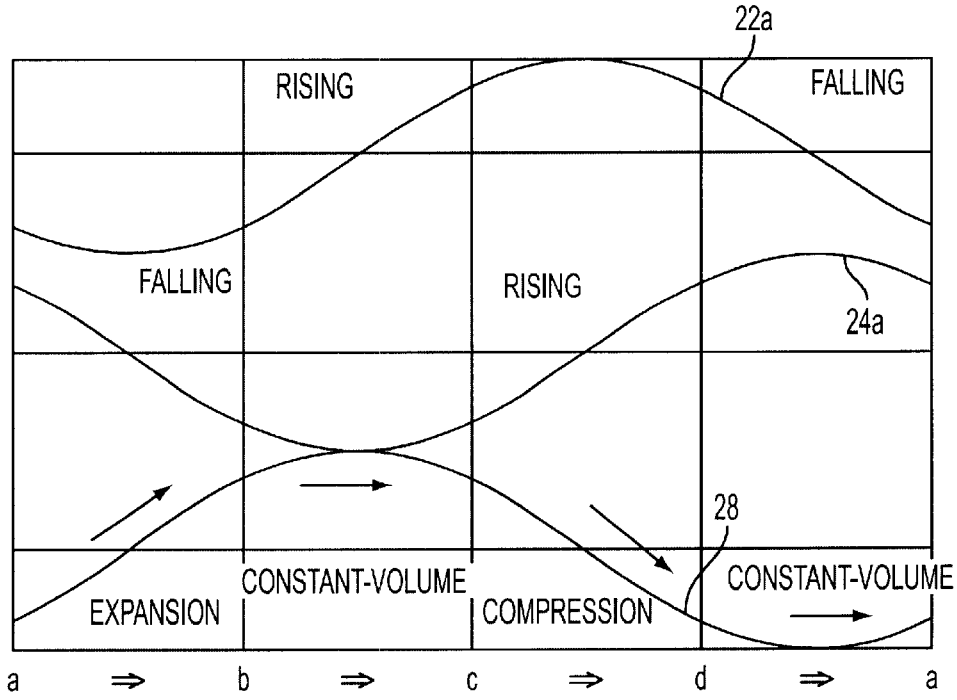
FIG. 3 (PRIOR ART)
FIG. 3 is a diagram showing a phase difference between a compression piston and a displacer in a Stirling cycle.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Hereinafter, although the modes of carrying out the present invention may be described herein based on FIG. 1, and embodiments of the same, the present invention is not limited only thereto.

Figure 4:
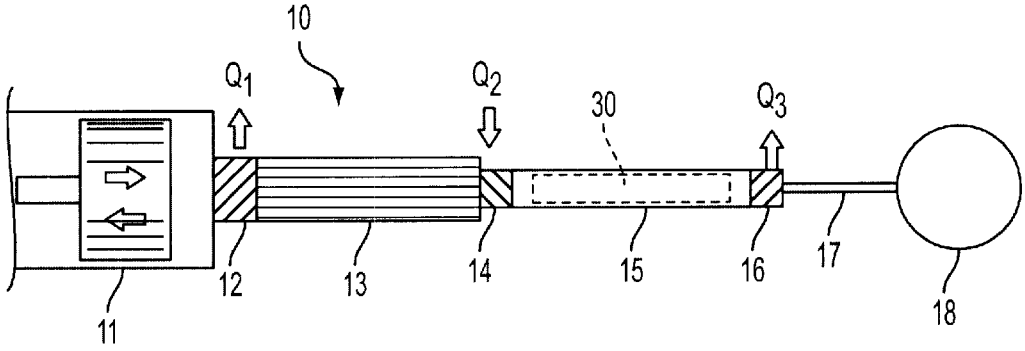
FIG. 4 (PRIOR ART)
FIG. 4 is an illustration of a schematic structural view of a pulse tube cryocooler.

FIG. 1 shows a schematic structure of a pulse tube cryocooler of an embodiment of the present invention. Incidentally, since the basic structure is the same as that of FIG. 4, substantially the same parts as those of FIG. 4 are designated by the same symbols, and their explanation is omitted herein.

In the pulse tube cryocooler 10, illustrated in FIG. 1, a connection pipe 11*a* coupled to a compressor (not shown), a heat radiation part 12, a regenerator 13, a cooling part 14, a pulse tube 15, and a heat radiation part 16 are sequentially connected, and, on the whole, form a cylindrical shape.

An inertance tube 17 is coupled to the pulse tube 15 through the heat radiation part 16, and further, a buffer tank 18 is coupled through the inertance tube 17.

This inertance tube 17 is coupled to the pulse tube 15 through the heat radiation part of the working gas oscillating in the pulse tube 15 and displacement of a compression piston of the compressor (not-shown) connected to the connection pipe 11*a*.

Further, a cooling fin 19*a* for heat radiation is provided around the heat radiation part 12, a cold head 19*b* is provided around the cooling part 14, and a heat radiating head part 19*c* is provided around the heat radiation part 16.

A heat transfer material for assisting heat conduction from the working gas is disposed in the heat radiation part 12, the cooling part 14, and the heat radiation part 16. Here, as the heat transfer material, a metal mesh of, for example, copper or aluminum, which are superior in heat conduction, can also be used.

In embodiments of the present invention, in the relation to the regenerator 13, the space volume in the pulse tube 15 and the length of the pulse tube 15 are important. It has been found that these relationships become factors when determining a refrigeration efficiency affected by the indicated refrigeration output and the heat loss. Incidentally, the length of the pulse tube in the invention corresponds to a distance L2 in the axial direction between the cooling part 14 and the heat radiation part 16 in FIG. 1.

Although the particular material used for the pulse tube 15 is not limited, in view of a preferential strength, heat conduction and the like, a metal is preferable, and especially stainless. In addition, since the length L2 of the pulse tube 15 is determined according to its relationship to the regenerator 13, as described later, it is similarly not particularly limited. However, but in the case where the refrigeration output is approximately 2 W, the length 12 of the pulse tube 15 is preferably in the range of 40 to 100 mm. It is preferable that the space volume of the pulse tube 15 is in the range of 5 to 30 ml.

A regenerating agent having a large heat capacity should be disposed in regenerator 13. Here, as the regenerating agent, a well-known material such as a stainless mesh or ball can be used, though embodiments of the present invention are not limited thereto. Although a filling amount can be suitably selected, preferably, a void ratio to the space volume of the regenerator 13 is between 60% to 80% volume %.

In embodiments of the present invention, the space volume, inner diameter, and length of the regenerator 13 are important in the relation to the pulse tube 15, and become factors in determining the refrigeration efficiency, due to the indicated refrigeration output and the heat loss. Here, the length of the regenerator 13 in the invention corresponds to a length L1 in the axial direction between the heat radiation part 12 and the cooling part 14, as illustrated in FIG. 1. The inner diameter corresponds to a diameter D in the case where the inner cross section of the regenerator 13 in FIG. 1 is converted into a circle.

The space volume of the regenerator 13 may be regulated by its relationship to space volume and length of the pulse tube 15, e.g., preferably the range is 5 to 30 ml. Further, the length L1 of the regenerator 13 is preferably in the range of 40 to 100 mm, and the inner diameter D of the regenerator 13 is preferably in the range of 15 to 20 mm.

Next, the relationship between the regenerator 13 and the pulse tube 15 will be described.

In embodiments of the present invention, it may become necessary for the ratio of the space volume of the pulse tube 15 to the space volume of the regenerator 13 be 0.75 to 1.5, e.g., preferably the range is 0.8 to 1.4. From the viewpoint of the indicated refrigeration output, the pressure amplitude generated in the compressor can be efficiently transmitted to the pulse tube 15, and the heat loss can be suppressed by the heat resistance of the regenerator 13, so that the refrigeration efficiency of the pulse tube cryocooler can be improved and the refrigeration output can be raised.

In the case where the above ratio is less than 0.75, the space volume of the regenerator 13 is excessively large, or the space volume of the pulse tube 15 is excessively small.

In the case where the space volume of the regenerator 13 is excessively large, although the heat capacity and the surface area of the regenerating agent are increased and the effect of reducing the heat loss is increased, the ratio (compression ratio) of the pressure amplitude generated in the compressor to the pressure amplitude transmitted to the pulse tube 15 is decreased and the pressure amplitude in the pulse tube 15 is decreased, and consequently, the indicated refrigeration output is decreased, thereby lowering the refrigeration efficiency, which of course is not preferable. In the case where the space volume of the pulse tube 15 is excessively small, since the so-called gas piston is not formed in the pulse tube 15, the indicated refrigeration output is decreased and the refrigeration efficiency is lowered as well, which is also not preferable.

On the other hand, when the above ratio exceeds 1.5, the interval volume of the regenerator 13 becomes excessively small or the space volume of the pulse tube 15 becomes excessively large, and in the case of the former, the heat capacity of the regenerator 13 and the surface area of the regenerating agent are decreased and the heat loss is increased, and in the case of the latter, the space volume of the pulse tube 15 is increased, so that the compression ratio is decreased, the indicated refrigeration output is decreased, and the refrigeration efficiency is lowered, and this is not preferable.

In accordance with embodiments of the present invention, it is preferable that the ratio of the length L2 of the pulse tube 15 to the length L1 of the regenerator 13, that is, L2/L1 is 0.9 to 1.9, more preferably, 1.0 to 1.7. By this, since the loss of the pressure amplitude generated in the compressor can be further lowered, the refrigeration efficiency can be improved and the refrigeration output can be raised.

In the case where the above ratio is less than 0.9, the length of the regenerator 13 becomes excessively large, the pressure loss in the regenerator 13 is increased, and the indicated refrigeration output is lowered, and this is not preferable, while when it exceeds 1.9, the length of the regenerator 13 becomes excessively small, the quantity of heat conducting through the structural member of the regenerator 13 is increased, heat resistance in the axial direction is decreased, heat loss is increased, and the refrigeration efficiency is lowered, which is not preferable.

Further, in accordance with embodiments of the present invention, a value obtained by dividing the length L1 of the regenerator 13 by the square of the inner diameter D should be within a range of 0.11 to 0.26, and preferably within the range of 0.15 to 0.25. Using this range, the heat resistance of the regenerator 13 in the axial direction can be made as large as possible, the heat loss can be suppressed, the pressure loss in the regenerator 13 suppressed, the pressure amplitude generated in the compressor efficiently transmitted to the pulse tube 15, and the indicated refrigeration output raised.

Where the above ratio is less than 0.11, the length of the regenerator 13 becomes excessively small, the heat resistance in the axial direction is decreased, the heat loss is increased, or the space volume becomes excessively large by the increase of the inner diameter D, the pressure ratio is lowered, the indicated refrigeration output is decreased, and the refrigeration efficiency is lowered, which is not preferable. Conversely, when the above ratio exceeds 0.26, since the length of the regenerator 13 becomes excessively large, the pressure loss is increased, the indicated refrigeration output is lowered, and the refrigeration efficiency is lowered, which similarly is not preferable.

Next, the operation of this pulse tube cryocooler 10 will be described.

The compressor (not shown) can be connected to the connection pipe 11*a* to make up a hermetically sealed space, with a working gas such as helium being sealed in the sealed space. Although the working gas is not particularly limited, helium, nitrogen, hydrogen, oxygen, or the like can be used. In the case where it is used at a cryogenic temperature of 70 K or lower, it is preferable to use helium or hydrogen so that the working gas is not liquefied. It is also preferable that the sealing pressure of the working gas is made 2 to 4 MPa.

When the pressure amplitude is applied to the working gas using the compressor, the working gas in the pulse tube 15 is minutely oscillated by the foregoing operation principle. Heat is then radiated from the heat radiation part 16, and a cryogenic temperature state is formed by the cooling part 14 which becomes the cold head of the cryocooler. In this case, the pressure amplitude applied to the working gas is preferably 0.1 to 0.4 MPa, with a preferable frequency of 45 to 55 Hz.

When an object to be cooled is disposed in the cooling part 14, heat can be absorbed from the object, heat will be radiated from the heat radiation part 16, and heat radiation to the outside of the system is then performed.

At this time, since the ratio of the space volume of the pulse tube 15 to the space volume of the regenerator 13 is made to be in the range of 0.75 to 1.5, the pressure amplitude generated in the compressor is efficiently transmitted to the pulse tube 15 to increase the indicated refrigeration output, and the heat resistance of the regenerator 13 is suitably given and the heat loss can be lowered. This results in a high refrigeration efficiency under the optimum conditions.

Hereinafter, although embodiments of the present invention will be described in more detail by use of examples, the invention is not limited to these examples.

EXAMPLE 1

In the first example, a pulse tube cryocooler, as shown in FIG. 1, was used, and the ratio of the space volume of the pulse tube to the space volume of the regenerator was changed under various conditions. The refrigeration output (W) at a cooling temperature of 70 K was measured. The results are shown in FIG. 5.

Incidentally, the operation conditions of the cryocooler were made such that a helium gas, as the working gas, was sealed at a pressure of 2.1 MPa, the pressure amplitude was made 0.2 MPa, and the frequency was made 50 Hz. The material of the regenerator and the pulse tube was made stainless, and as the regenerating agent in the regenerator, a stainless mesh of 400 mesh was disposed so that a filling rate became 60%. A copper mesh of 100 mesh was used as the heat conduction material.

Figure 5:
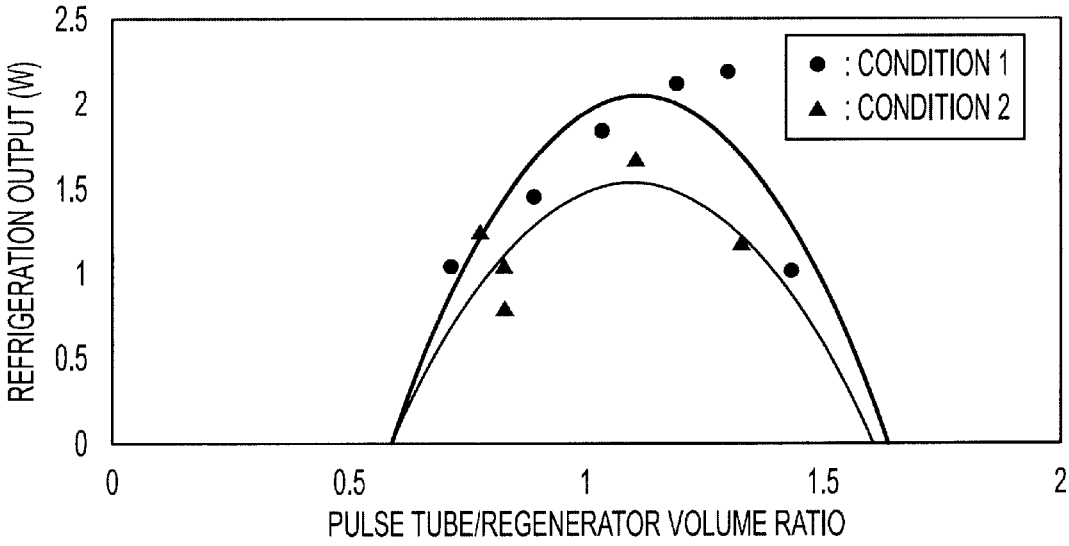
FIG. 5 is an illustration of a diagram showing results of an embodiment of the present invention according to a first example.

FIG. 5 is a graph showing the relation between the ratio of the space volume of the pulse tube to the space volume of the regenerator and the refrigeration output. The horizontal axis indicates the value obtained by dividing the space volume of the pulse tube by the space volume of the regenerator, and the vertical axis indicates the refrigeration output at a cooling temperature of 70 K. In the FIG. 5, condition 1 indicates the case where the inner diameter of the pulse tube is made to be 15 mm, and the inner diameter of the regenerator is made to be 20 mm. Condition 2 indicates the case where the inner diameter of the pulse tube is made to be 14 mm, and the inner diameter of the regenerator is made to be 18 mm. A solid line 1 and a solid line 2 represent regression equations to quadratic curves of measurement values under condition 1 and condition 2.

EXAMPLE 2

From the result of FIG. 5, the refrigeration output has the relation projecting upward with respect to a ratio of the space volume of the pulse tube to the space volume of the regenerator, with the refrigeration output being high when the ratio is 0.75 to 1.5.

Figure 6:
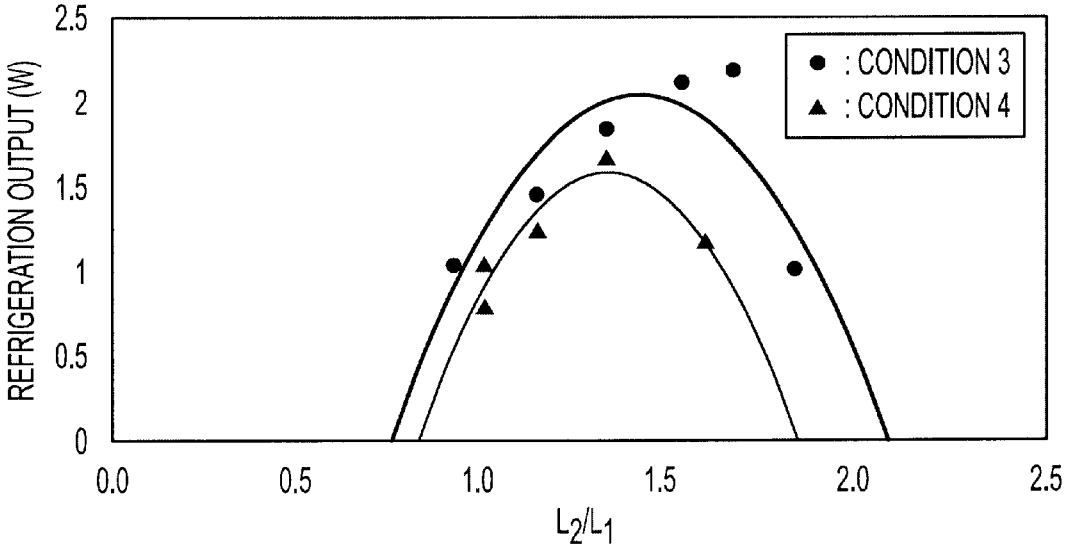
FIG. 6 is an illustration of a diagram showing results of an embodiment of the present invention according to a second example.

A pulse tube cryocooler, as shown in FIG. 1, was used. The ratio (L2/L1) of the length L2 of a pulse tube to the length L1 of a regenerator was changed under various conditions, and refrigeration output (W) at a cooling temperature of 70K was measured. The results are shown in FIG. 6. Incidentally, the working conditions of the cryocooler were made similar to those of the example 1.

FIG. 6 is a graph showing the relationship between a ratio of the length of the pulse tube to the length of the regenerator and the refrigeration output. The horizontal axis indicates the value obtained by dividing the length of the pulse tube by the length of the regenerator, and the vertical axis indicates the refrigeration output at a cooling temperature of 70 K. In FIG. 6, condition 3 indicates measurement values when the inner diameter of the pulse tube is made to be 15 mm, and the inner diameter of the regenerator is made to be 20 mm, and condition 4 indicates measurement values when the inner diameter of the pulse tube is made to be 14 mm, and the inner diameter of the regenerator is made to be 18 mm. A solid line 3 and a solid line 4 respectively represent regression equations to quadratic curves of the measurement values under the condition 3 and the condition 4.

As illustrated in FIG. 6, the refrigeration output illustrates the relation projecting upward with respect to a ratio of the length of the pulse tube to the length of the regenerator, with the refrigeration output being high when this ratio is 0.9 to 1.9.

EXAMPLE 3

Figure 7:
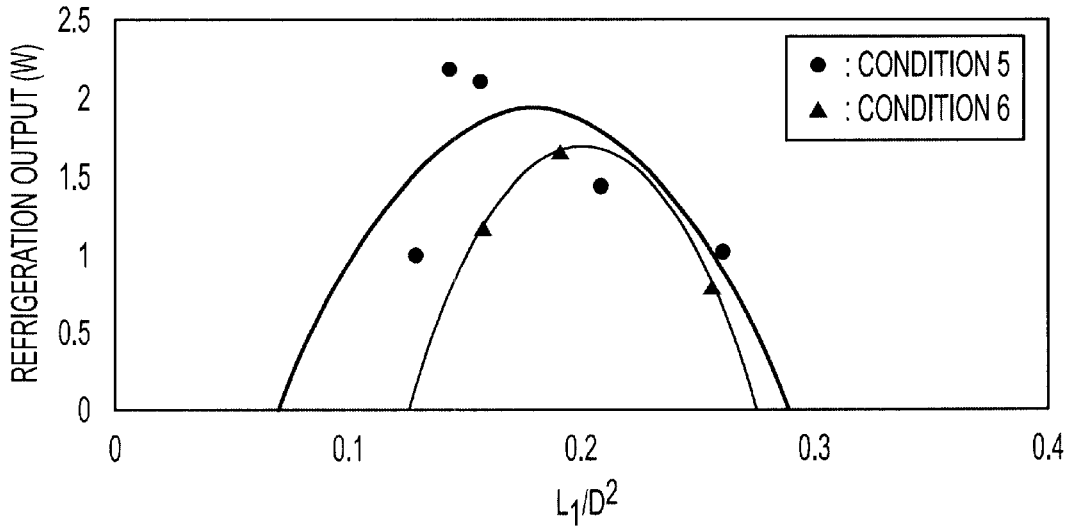
FIG. 7 is an illustration of a diagram showing results of an embodiment of the present invention according to a third example.

A pulse tube cryocooler, as shown in FIG. 1, was used. A value obtained by dividing the length L1 of the regenerator by the square of the inner diameter D was changed under various conditions, and the refrigeration output (W) at a cooling temperature of 70 K was measured. The results are shown in FIG. 7. The working conditions of the cryocooler were made similar to those of the example 1.

FIG. 7 is a graph showing the relationship between a value obtained by dividing the length L1 of the regenerator by the square of the inner diameter D of the regenerator and the refrigeration output. The horizontal axis indicates the value obtained by dividing the length L of the regenerator by the square of the inner diameter D of the regenerator, and the vertical axis indicates the refrigeration output at a cooling temperature of 70 K. In FIG. 7, condition 5 indicates measurement values in the case where the inner diameter of the regenerator is made to be 20 mm, and condition 6 indicates measurement values in the case where the inner diameter of the regenerator is made to be 18 mm. A solid line 5 and a solid line 6 respectively represent regression equations to quadratic curves of the measurement values under the condition 5 and the condition 6.

From the results of FIG. 7, the refrigeration output illustrates the relation projecting upward with respect to a value obtained by dividing the length L1 of the regenerator by the square of the inner diameter D of the regenerator, with the refrigeration output being high when this range of this value is 0.11 to 0.26.

EXAMPLE 4

A pulse tube cryocooler of the structure of FIG. 1 was used. The ratio of the cross section of the inner space of the pulse tube 15 to the cross section of the inner space of the regenerator 13 was changed, and a cooling operation at a cooling temperature of 70 K was performed. Refrigeration output was measured when installation was made such that the pulse tube 15 was positioned to be higher than the regenerator 13, and when installation was made such that the pulse tube 15 was positioned to be lower than the regenerator 13. Helium gas was used as the working gas and sealed at a pressure of 2.1 MPa. The helium was worked at a pressure amplitude of 0.2 MPa and a frequency of 50 Hz. The regenerator 13 and the pulse tube 15 were formed of stainless steel, e.g., a stainless steel mesh of 400 mesh was used as a regenerating agent, and it was filled in the regenerator 13 so that the filling rate became 60%. A copper mesh of 100 mesh was used as the heat transfer material for the heat radiation part 12, the cooling part 14 and the heat radiation part 16.

Figure 8:
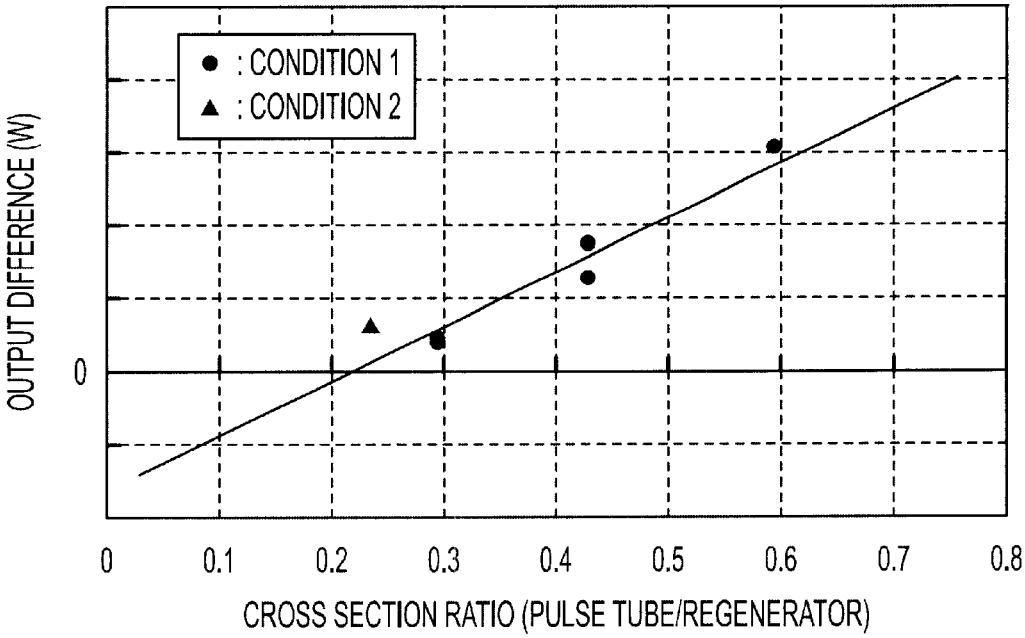
FIG. 8 is an illustration of a diagram showing results of an embodiment of the present invention according to a fourth example.

FIG. 8 is a characteristic view showing results obtained in this measurement test. In FIG. 8, the vertical axis indicates the difference between the refrigeration output when installation was made such that the pulse tube 15 was positioned to be higher than the regenerator 13, and the refrigeration output when installation was made such that the pulse tube 15 was positioned to be lower than the regenerator 13. The horizontal axis indicates the ratio of the cross section of the inner space of the pulse tube 15 to the cross section of the inner space of the regenerator 13. In FIG. 8, characteristic values (condition 1) designated by • indicate measurement values in the case where the regenerator with the inner diameter of 18 mm was used, and characteristic values (condition 2) designated by ♦ indicate measurement values in the case where the regenerator with the inner diameter of 20 mm was used. A solid line is a linear regression equation of the measurement values.

As seen in FIG. 8, in the test range, the difference between the refrigeration outputs due to the installation states has a linear relation with the ratio of the cross section of the pulse tube to the cross section of the regenerator. It is understood that particularly in the case where the ratio of the cross section of the pulse tube to the cross section of the regenerator is 0.1 to 0.35, the difference between the refrigeration outputs due to the installation states is suppressed to be minute. Accordingly, if the ratio of the cross section of the pulse tube to the cross section of the regenerator is selected in the range of 0.1 to 0.35. If the installation posture is changed up and down, the change of the obtained refrigeration output is suppressed to be minute, and the stable refrigeration output can be obtained.

The heat loss by natural convection of the working gas in the pulse tube cryocooler includes a heat loss A due to natural convection of the working gas in the inner space of the pulse tube 15, and a heat loss B due to natural convection of the working gas in the inner space of the regenerator 13. Since the positions of the high temperature part and the low temperature part in the up and down directions comes to have the opposite direction between the pulse tube 15 and the regenerator 13, in the case where installation is made such that the pulse tube 15 is positioned to be higher than the regenerator 13, the heat loss A is increased, and the heat loss B is suppressed to be minute. On the other hand, in the case where installation is made such that the pulse tube 15 is positioned to be lower than the regenerator 13, the heat loss B is increased, and the heat loss A is suppressed to be minute. Accordingly, as described above, if the ratio of the cross section of the pulse tube to the cross section of the regenerator is selected to be 0.1 to 0.35, since the heat loss A in the case where installation is made such that the pulse tube 15 is positioned to be higher than the regenerator 13 becomes equal to the heat loss B in the case where installation is made such that the pulse tube 15 is positioned to be lower than the regenerator 13, even if the installation posture is changed in the up and down directions, an almost equal refrigeration output can be obtained.

In the case where the ratio of the cross section of the pulse tube to the cross section of the regenerator is smaller than 0.1, since the cross section of the regenerator becomes relatively excessively large, and the heat loss B in the case where installation is made such that the pulse tube is positioned to be lower than the regenerator becomes large as compared with the heat loss A in the case where installation is made such that the pulse tube is positioned to be higher than the regenerator, when the pulse tube is positioned at the lower part, the refrigeration output is greatly lowered. When the ratio of the cross section of the pulse tube to the cross section of the regenerator exceeds 0.35, since the cross section of the pulse tube becomes relatively excessively large, and the heat loss A of the pulse tube is relatively increased, when the pulse tube is positioned at the upper part, the refrigeration output is greatly lowered.

EXAMPLE 5

A pulse tube cryocooler of the structure of FIG. 1 was used. The inner diameter of the pulse tube 15 was changed to perform a cooling operation at a cooling temperature of 70 K, and refrigeration output was measured when installation was made such that the pulse tube 15 was positioned to be higher than the regenerator 13, and when installation was made such that the pulse tube 15 was positioned to be lower than the regenerator 13. Incidentally, at this time, a helium gas was used as the working gas, and was sealed at a pressure of 3.1 MPa, and worked at a pressure amplitude of 0.2 MPa and a frequency of 50 Hz. Besides, the material of the regenerator 13 and the pulse tube 15 was made of stainless steel, a stainless mesh of 400 mesh was used for the regenerating agent, and was filled in the regenerator 13 so that the filling rate became 60%. A copper mesh of 100 mesh was used for the heat conduction material of the heat radiation part 12, the cooling part 14, and the heat radiation part 16.

Figure 9:
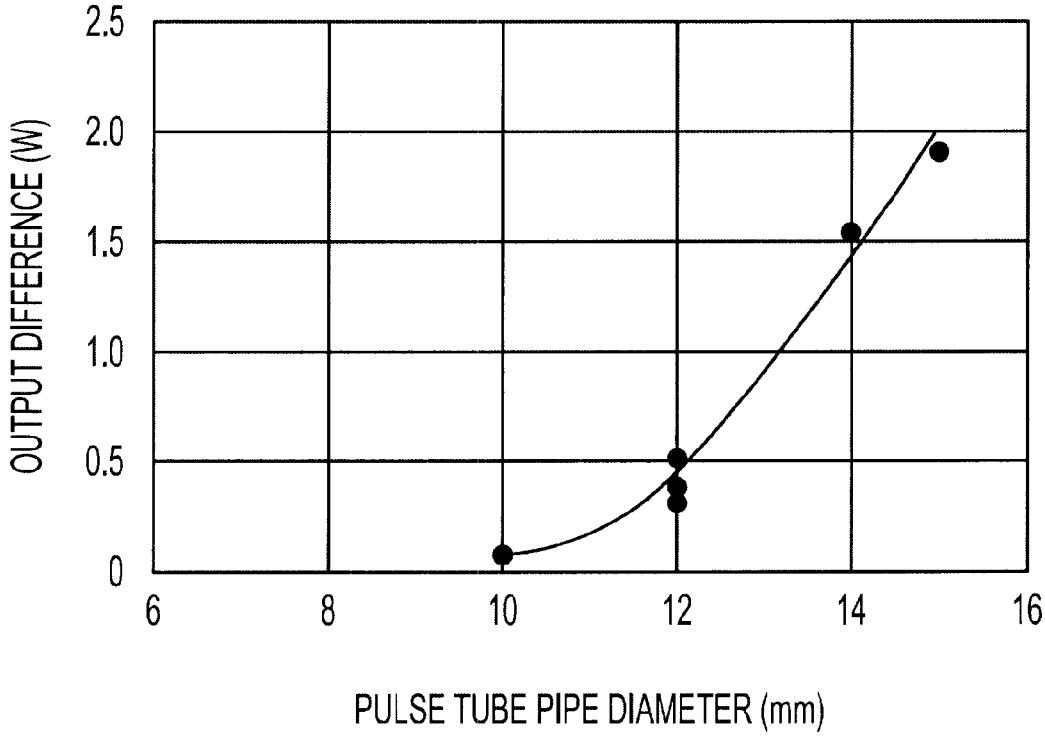
FIG. 9 is an illustration of a diagram showing results of an embodiment of the present invention according to a fifth example.

FIG. 9 is a characteristic view illustrating results obtained in this measurement test. In FIG. 9, the vertical axis indicates the difference between the refrigeration output when installation was made such that the pulse tube 15 was positioned to be higher than the regenerator 13, and the refrigeration output when installation was made such that the pulse tube 15 was positioned to be lower than the regenerator 13. The horizontal axis indicates the inner diameter of the pulse tube 15. In FIG. 9, characteristic values designated by • are measurement values, and a solid line is a linear regression equation of these measurement values.

As shown in FIG. 9, as the inner diameter of the pulse tube 15 is decreased, the difference between the refrigeration outputs due to the installation states is decreased. Where the inner diameter of the pulse tube 15 is not larger than 12 mm, the difference between the refrigeration outputs due to the installation states is suppressed to be minute. Accordingly, if the inner diameter of the pulse tube is selected to be 12 mm or less, even if the installation posture is changed, the change in the obtained refrigeration output can be suppressed to be minute, and a stable refrigeration output can be obtained.

As described above, according to embodiments of the present invention, the pulse tube cryocooler having high refrigeration efficiency can be provided by regulating and optimizing the space volume and the length of the regenerator and the pulse tube at a definite ratio. Since it becomes possible to efficiently obtain a low temperature in the vicinity of 70 K, the invention can be suitably used, for example, in the field of cooling a high temperature superconducting element.

In addition, according to further embodiments of the present invention, in a pulse tube cryocooler in which the pulse tube and the regenerator are disposed linearly, since the ratio of the inner cross section of the pulse tube to the inner cross section of the regenerator, and the inner diameter of the pulse tube are selected to be predetermined values and are optimized, the difference between the refrigeration outputs due to the difference in the installation posture is lessened, and a stable output can be obtained even under various installation conditions Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A pulse tube cryocooler, comprising:

a regenerator coupled to a compressor through a heat radiation part and having an internal regenerating agent, with the compressor repeatedly feeding and suctioning a working gas;

a pulse tube coupled to the regenerator through a cooling part; and a buffer tank coupled to the pulse tube through a heat radiation part and an inertance tube, characterized in that a ratio of a space volume of the pulse tube to a space volume of the regenerator is between 0.75 to 1.5.

2. The pulse tube cryocooler of claim 1, wherein a ratio of a length of the pulse tube to a length of the regenerator is between 0.9 to 1.9.

3. A pulse tube cryocooler, comprising:

a regenerator coupled to a compressor through a heat radiation part and having an internal regenerating agent, with the compressor repeatedly feeding and suctioning a working gas;

a pulse tube coupled to the regenerator through a cooling part; and a buffer tank coupled to the pulse tube through a heat radiation part and an inertance tube, wherein when a diameter of a circle having an area equal to an inner cross section of the regenerator is made an inner diameter, a value obtained by dividing a length of the regenerator by a square of the inner diameter is between 0.11 to 0.26.

4. A pulse tube cryocooler in which a pulse tube and a regenerator are linearly disposed, the pulse tube cryocooler wherein a ratio of an inner cross section of the pulse tube to an inner cross section of the regenerator is not less than 0.1 and not higher than 0.35.

5. The pulse tube cryocooler of claim 1, wherein the inner diameter of the pulse tube is 12 mm or less.

6. The pulse tube cryocooler of claim 2, wherein the inner diameter of the pulse tube is 12 mm or less.

7. The pulse tube cryocooler of claim 3, wherein the inner diameter of the pulse tube is 12 mm or less.

8. The pulse tube cryocooler of claim 4, wherein the inner diameter of the pulse tube is 12 mm or less.

9. The pulse tube cryocooler of claim 1, wherein the ratio of the space volume of the pulse tube to the space volume of the regenerator is greater than 1.0 and less than 1.25.

10. The pulse tube cryocooler of claim 2, wherein the ratio of the length of the pulse tube to the length of the regenerator is greater than 1.0.

11. The pulse tube cryocooler of claim 4, wherein the ratio of the inner cross section of the pulse tube to the inner cross section of the regenerator is greater than 0.15 and less than 0.275.

* * * * *